US006810870B1

(12) United States Patent
Hu

(10) Patent No.: US 6,810,870 B1
(45) Date of Patent: Nov. 2, 2004

(54) TOY GUN

(75) Inventor: Shih-Che Hu, Taichung (TW)

(73) Assignee: Yih Kai Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 10/743,679

(22) Filed: Dec. 19, 2003

(30) Foreign Application Priority Data

Oct. 29, 2003 (TW) ..... 092219312 U

(51) Int. Cl.[7] ..... F41B 11/32
(52) U.S. Cl. ..... 124/76; 124/73; 124/74
(58) Field of Search ..... 124/73, 74, 75, 124/76, 83, 31

(56) References Cited

U.S. PATENT DOCUMENTS 4,616,622 A * 10/1986 Milliman ..... 124/73
5,494,024 A * 2/1996 Scott ..... 124/73
5,509,399 A * 4/1996 Poor ..... 124/76
5,515,838 A * 5/1996 Anderson ..... 124/76
5,711,286 A * 1/1998 Petrosyan et al. ..... 124/73
6,276,354 B1 * 8/2001 Dillon ..... 124/74
6,497,229 B1 * 12/2002 Maeda ..... 124/76
6,561,176 B1 * 5/2003 Fujimoto et al. ..... 124/76
6,708,685 B2 * 3/2004 Masse ..... 124/75
2003/0106545 A1 * 6/2003 Verini ..... 124/74

FOREIGN PATENT DOCUMENTS

JP 401167596 A * 3/1989

* cited by examiner

*Primary Examiner*—Derris H. Banks
*Assistant Examiner*—Faye Francis

(57) ABSTRACT

A toy gun includes a gun body, a support seat, a magazine, a gas control device, and a slide. The gas control device is mounted in the support seat and includes a link, a press plate, a baffle, a first clamping block, a driven block, a second clamping block, a limit plate, a hammer, a first shaft, and a second shaft. Thus, the gas control device can control operation of the gas valve of the gas chamber of the magazine exactly, so that the toy gun is operated smoothly and stably.

17 Claims, 11 Drawing Sheets

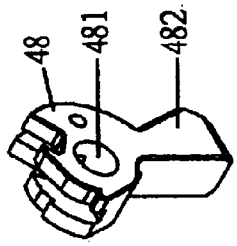
FIG.4B
FIG.4A
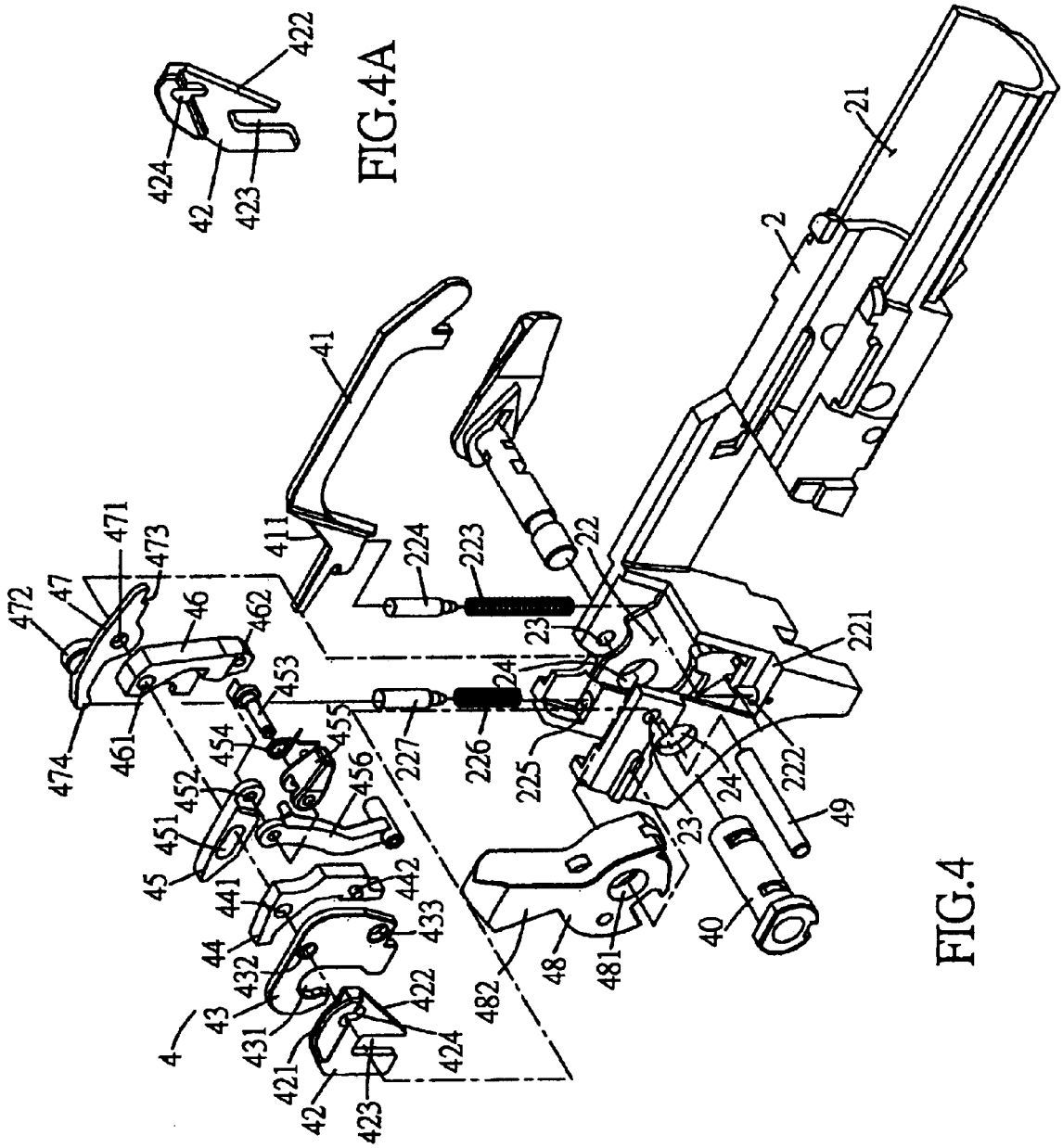
FIG.4

TOY GUN

BACKGROUND OF THE INVENTION

1. Field of the Invention

The present invention relates to a toy gun, and more particularly to a toy gun that is operated smoothly and stably.

2. Description of the Related Art

A conventional toy gun comprises a gun body, a magazine mounted in the gun body and having a first side formed with a bullet chamber for mounting a compression spring, a push block and a plurality of BB bullets and a second side formed with a gas chamber containing high pressure gas, and a gas control device mounted on the gun body for guiding the high pressure gas from the gas chamber of the magazine to flow toward the barrel of the gun body, so that the uppermost BB bullet is pressed by the high pressure gas and is ejected outward from the barrel.

However, the gas control device cannot control the gas flow of the gas chamber of the magazine easily and exactly, so that the toy gun is not operated smoothly and stably, thereby causing inconvenience to the user.

SUMMARY OF THE INVENTION

The primary objective of the present invention is to provide a toy gun, wherein the gas control device can control operation of the gas valve of the gas chamber of the magazine exactly, so that the toy gun is operated smoothly and stably.

Another objective of the present invention is to provide a toy gun, wherein the striking portion of the hammer strikes the valve block of the gas guide valve of the slide to actuate the gas guide valve of the slide to guide the high pressure gas from the gas chamber of the magazine to flow toward the barrel of the slide, so that the uppermost BB bullet is pressed by the high pressure gas and is ejected outward from the barrel of the slide rapidly and actually.

In accordance with the present invention, there is provided a toy gun, comprising a gun body, a support seat, a magazine, and a gas control device, wherein:

the gun body has a vertical section formed with a magazine chamber, a horizontal section formed with a receiving channel and a mediate section provided with a trigger chamber for mounting a trigger;

the support seat is mounted in the receiving channel of the gun body, the support seat has a first end formed with a spring chamber and a second end formed with a receiving recess, the receiving recess of the support seat has a first end having a side formed with an opening having a bottom formed with a first mounting hole for mounting a first compression spring and a first push rod, the receiving recess of the support seat has a second end having a side formed with a second mounting hole for mounting a second compression spring and a second push rod;

the magazine is mounted in the magazine chamber of the gun body;

the gas control device is mounted in the receiving recess of the support seat and includes a link, a press plate, a baffle, a first clamping block, a driven block, a second clamping block, a limit plate, a hammer, a first shaft, and a second shaft, wherein:

the link has a first end pivotally connected with an end of the trigger and a second end mounted in the opening of the support seat, the second end of the link has a first side rested on the first push rod of the support seat and a second side formed with an oblique pressing edge;

the press plate has a first end formed with a pressed block formed with a pivot hole and a second end formed with a mounting hole, the press plate has a side formed with an oblique pressing edge urged on the oblique pressing edge of the link;

the baffle has a first end formed with a pivot hole and a second end formed with a mounting hole, the baffle has a side formed with passage hole;

the first clamping block has a first section formed with a pivot hole and a second section formed with protruding stub;

the driven block has a first end formed with an elongated slot and a second end formed with a pivot hole for passage of a pivot shaft which is extended through a torsion spring, an end of an action block and an end of a lever;

the second clamping block has a first end formed with a pivot hole and a second end formed with a shaft hole;

the limit plate has a first end formed with a cutout for insertion of the pivot shaft of the driven block, a mediate portion formed with a pivot hole, and a second end formed with a pressing portion urged on the second push rod of the support seat, the second end of the limit plate is provided with a pressed block;

the hammer has a first end formed with a pivot hole and a second end formed with a striking portion;

the first shaft is in turn extended through the pivot hole of the press plate, the pivot hole of the baffle, the pivot hole of the first clamping block, the elongated slot of the driven block, the pivot hole of the second clamping block and the pivot hole of the limit plate; and the second shaft is in turn extended through the pivot hole of the hammer, the mounting hole of the press plate and the mounting hole of the baffle.

Further benefits and advantages of the present invention will become apparent after a careful reading of the detailed description with appropriate reference to the accompanying drawings.

BRIEF DESCRIPTION OF THE DRAWINGS

FIG. 4 is an exploded perspective view of the toy gun as shown in FIG. 1;

FIG. 4A is a partially perspective enlarged view of a press plate of the toy gun as shown in FIG. 4;

FIG. 4B is a partially perspective enlarged view of a hammer of the toy gun as shown in FIG. 4;

DETAILED DESCRIPTION OF THE INVENTION

Figure 1:
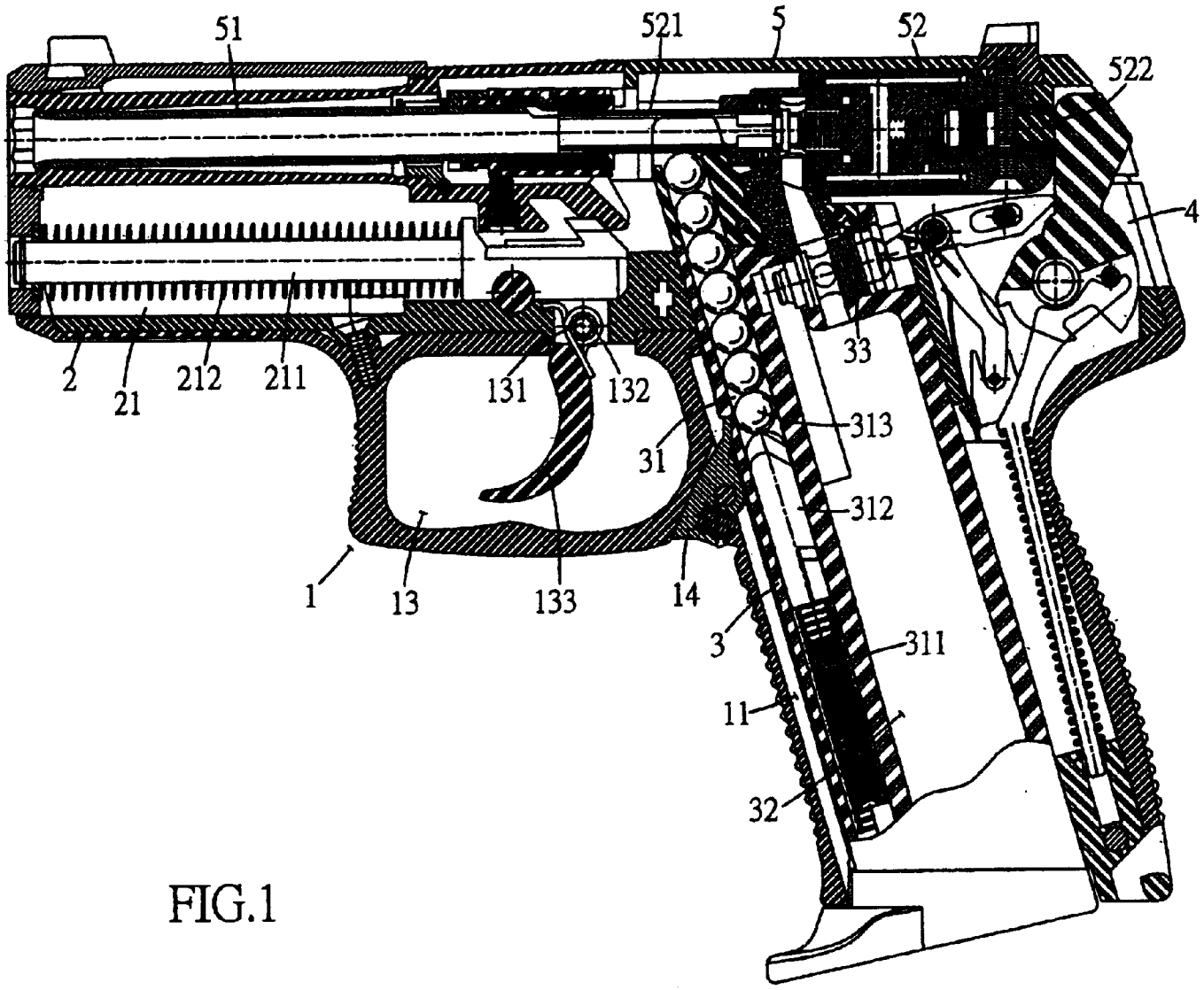
FIG. 1 is a side plan cross-sectional assembly view of a toy gun in accordance with the preferred embodiment of the present invention.

Referring to the drawings and initially to FIGS. 1–6, a toy gun in accordance with the preferred embodiment of the present invention comprises a gun body 1, a support seat 2, a magazine 3, a gas control device 4, and a slide 5.

The gun body 1 is substantially L-shaped, and has a vertical section formed with a magazine chamber 11, a horizontal section formed with a receiving channel 12 and a mediate section provided with a trigger chamber 13. The gun body 1 is provided with a magazine catch 14 located at a connection of the magazine chamber 11 and the trigger chamber 13. A trigger 133 is pivotally mounted in the trigger chamber 13 by a pivot axle 131, and a torsion spring 132 is mounted on the pivot axle 131 and urged between the trigger 133 and the gun body 1.

The support seat 2 is mounted in the receiving channel 12 of the gun body 1. The support seat 2 has a first end formed with a spring chamber 21. A sleeve 211 is mounted in the spring chamber 21 of the support seat 2, and a compression spring 212 is mounted on the sleeve 211 and is received in the spring chamber 21 of the support seat 2. The support seat 2 has a second end formed with a receiving recess 22. The receiving recess 22 of the support seat 2 has a first end having a side formed with an opening 221 having a bottom formed with a first mounting hole 222 for mounting a first compression spring 223 and a first push rod 224. The receiving recess 22 of the support seat 2 has a second end having a side formed with a second mounting hole 225 for mounting a second compression spring 226 and a second push rod 227. The second end of the support seat 2 has two side walls each formed with a first through hole 23 and a second through hole 24.

The magazine 3 is mounted in the magazine chamber 11 of the gun body 1. The magazine 3 has a first side formed with a bullet chamber 31 for mounting a compression spring 311, a push block 312 and a plurality of BB bullets 313. The magazine 3 has a second side formed with a gas chamber 32 having an end provided with a gas valve 33.

The gas control device 4 is mounted in the receiving recess 22 of the support seat 2 to open or close the gas flow.

The gas control device 4 includes a link 41, a press plate 42, a baffle 43, a first clamping block 44, a driven block 45, a second clamping block 46, a limit plate 47, a hammer 48, a first shaft 49, and a second shaft 40.

Figure 6:
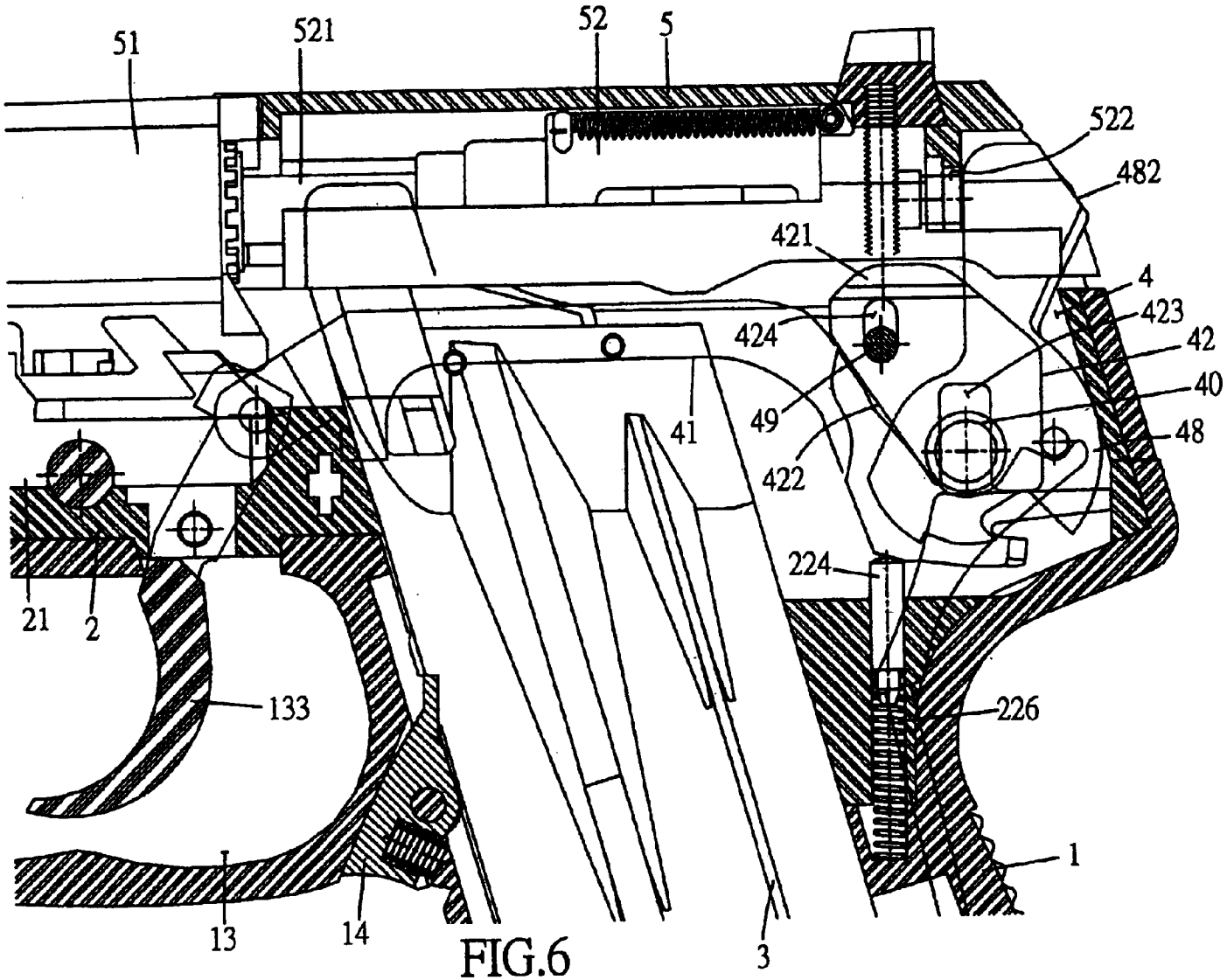
FIG. 6 is a partially cut-away side plan cross-sectional assembly view of the toy gun in accordance with the preferred embodiment of the present invention.

The link 41 has a first end pivotally connected with an end of the trigger 133 and a second end mounted in the opening 221 of the support seat 2. The second end of the link 41 has a first side rested on the first push rod 224 of the support seat 2 as shown in FIG. 6 and a second side formed with an oblique pressing edge 411.

The press plate 42 has a first end formed with a substantially L-shaped pressed block 421 formed with a pivot hole 424 and a second end formed with a substantially U-shaped mounting hole 423. The press plate 42 has a side formed with an oblique pressing edge 422 (see FIG. 4A) urged on the oblique pressing edge 411 of the link 41 as shown in FIG. 6.

The baffle 43 is a substantially hook-shaped plate and has a first end formed with a pivot hole 432 and a second end formed with a mounting hole 431. The baffle 43 has a side formed with passage hole 433.

The first clamping block 44 is a substantially L-shaped plate and has a first section formed with a pivot hole 441 and a second section formed with protruding stub 442.

The driven block 45 has a first end formed with an elongated slot 451 and a second end formed with a pivot hole 452 for passage of a pivot shaft 453 which is extended through a torsion spring 454, an end of an action block 455 and an end of a lever 456.

The second clamping block 46 has a fist end formed with a pivot hole 461 and a second end formed with a shaft hole 462.

Figure 5:
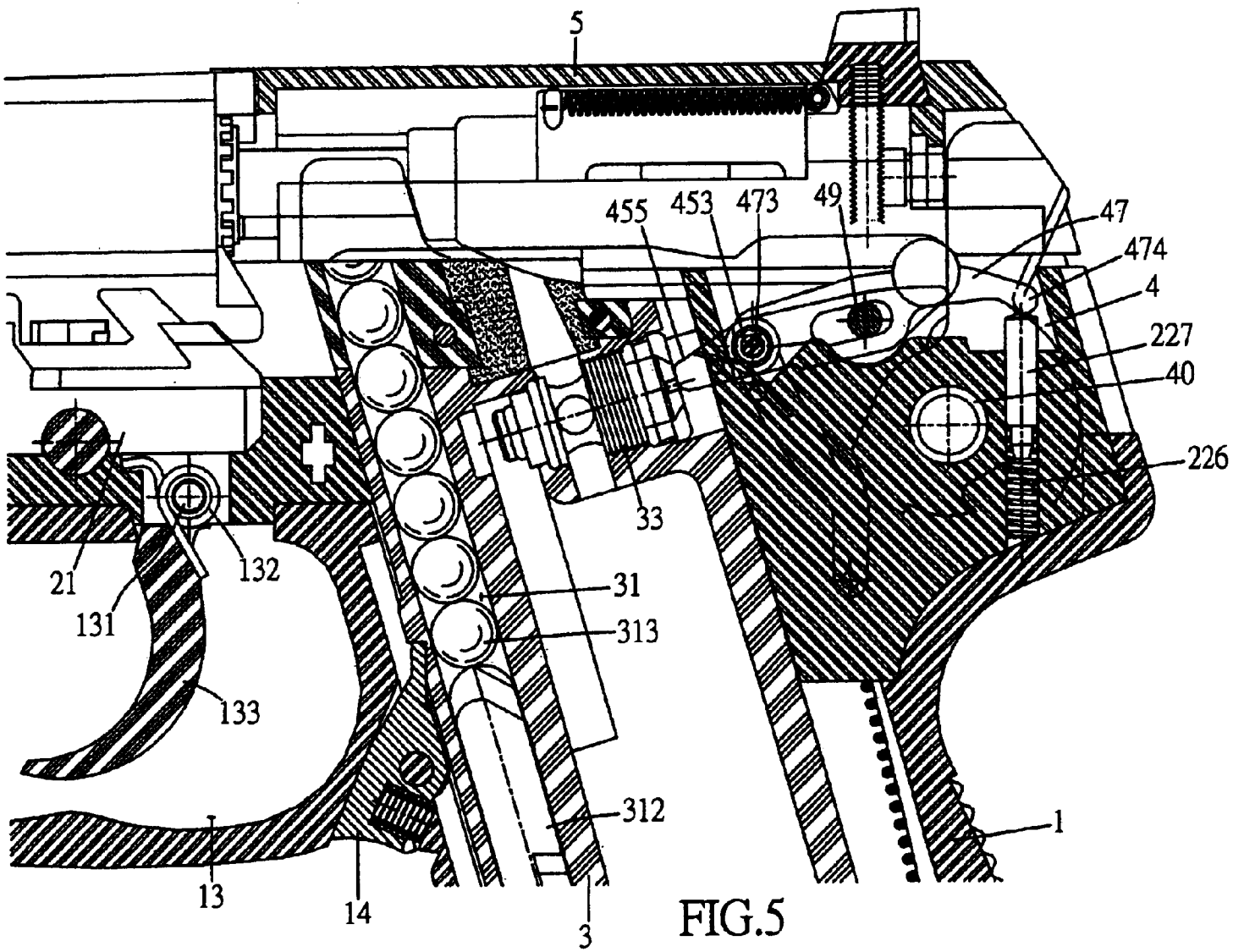
FIG. 5 is a partially cut-away side plan cross-sectional assembly view of the toy gun in accordance with the preferred embodiment of the present invention.

The limit plate 47 has a first end formed with a cutout 473 for insertion of the pivot shaft 453 of the driven block 45, a mediate portion formed with a pivot hole 471, and a second end formed with a pressing portion 474 urged on the second push rod 227 of the support seat 2 as shown in FIG. 5. The second end of the limit plate 47 is provided with a pressed block 472.

The hammer 48 has a first end formed with a pivot hole 481 and a second end formed with a striking portion 482 (see FIG. 4B).

The first shaft 49 is in turn extended through the pivot hole 424 of the press plate 42, the pivot hole 432 of the baffle 43, the pivot hole 441 of the first clamping block 44, the elongated slot 451 of the driven block 45, the pivot hole 461 of the second clamping block 46 and the pivot hole 471 of the limit plate 47 and has two ends each mounted in the first through hole 23 of the support seat 2.

The second shaft 40 is in turn extended through the pivot hole 481 of the hammer 48, the mounting hole 423 of the press plate 42 and the mounting hole 431 of the baffle 43 and has two ends each mounted in the second through hole 24 of the support seat 2.

Figure 2:
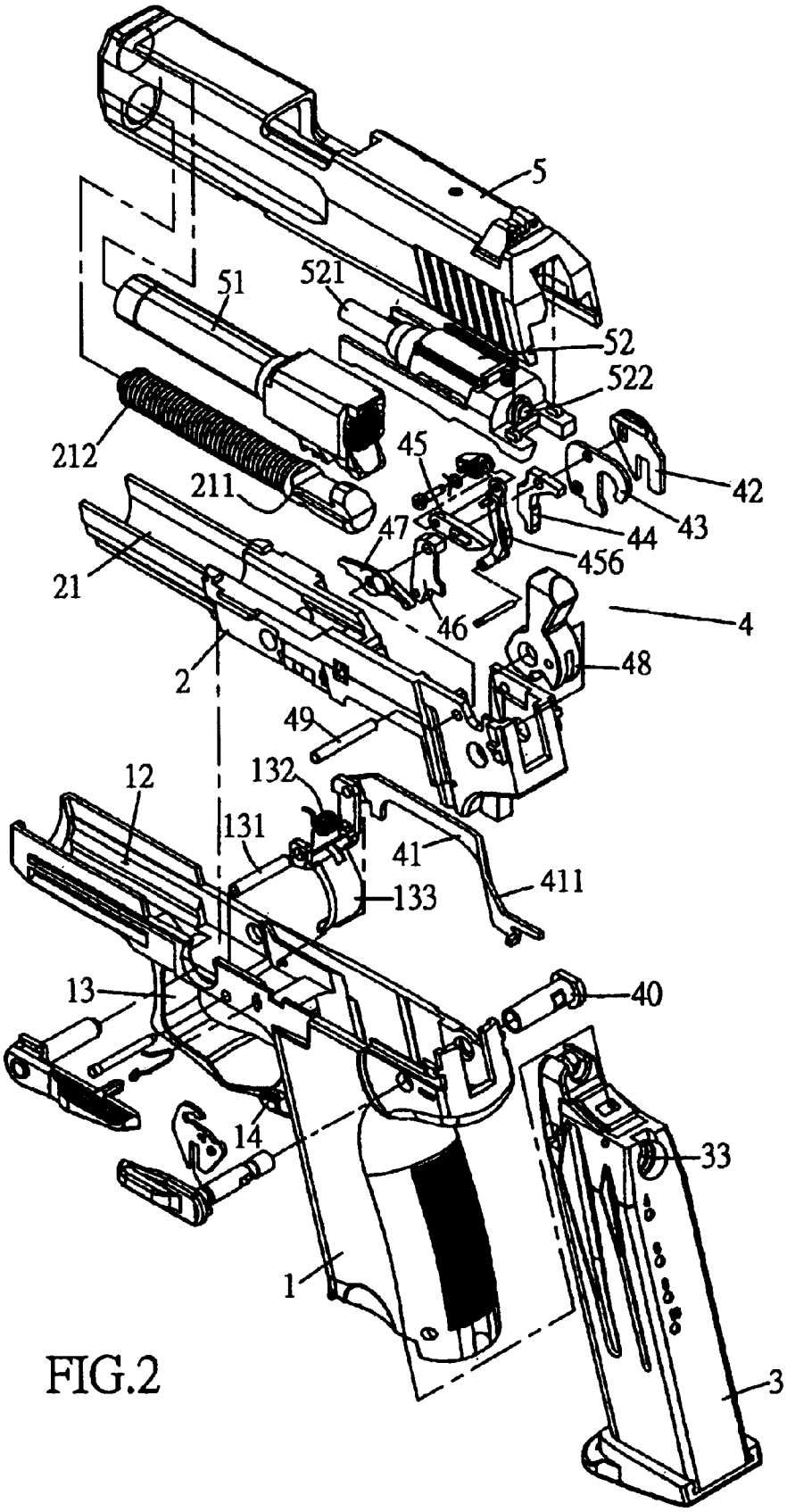
FIG. 2 is an exploded perspective view of the toy gun as shown in FIG. 1.
Figure 3:
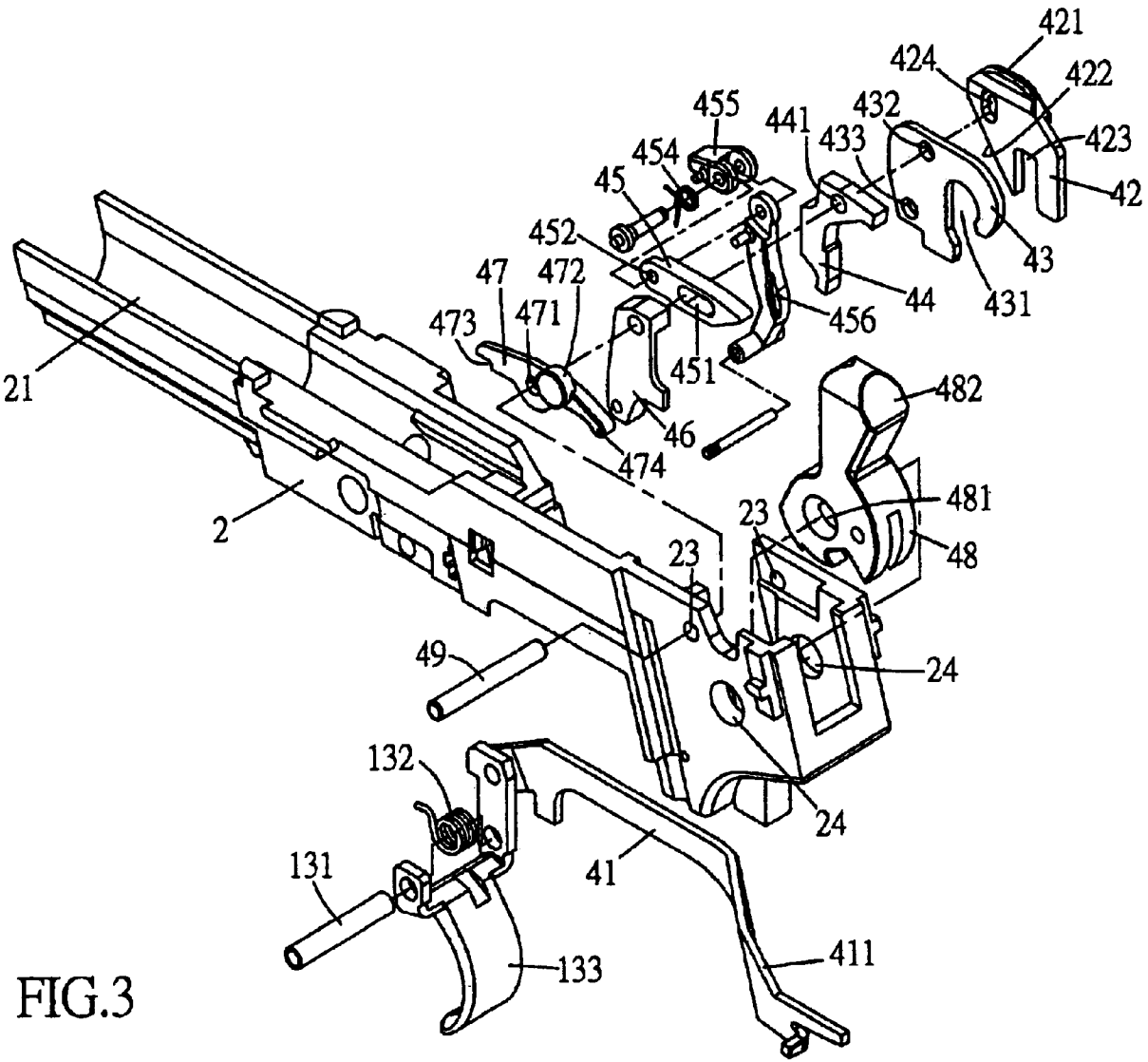
FIG. 3 is an exploded perspective view of the toy gun as shown in FIG. 1.
Figure 7:
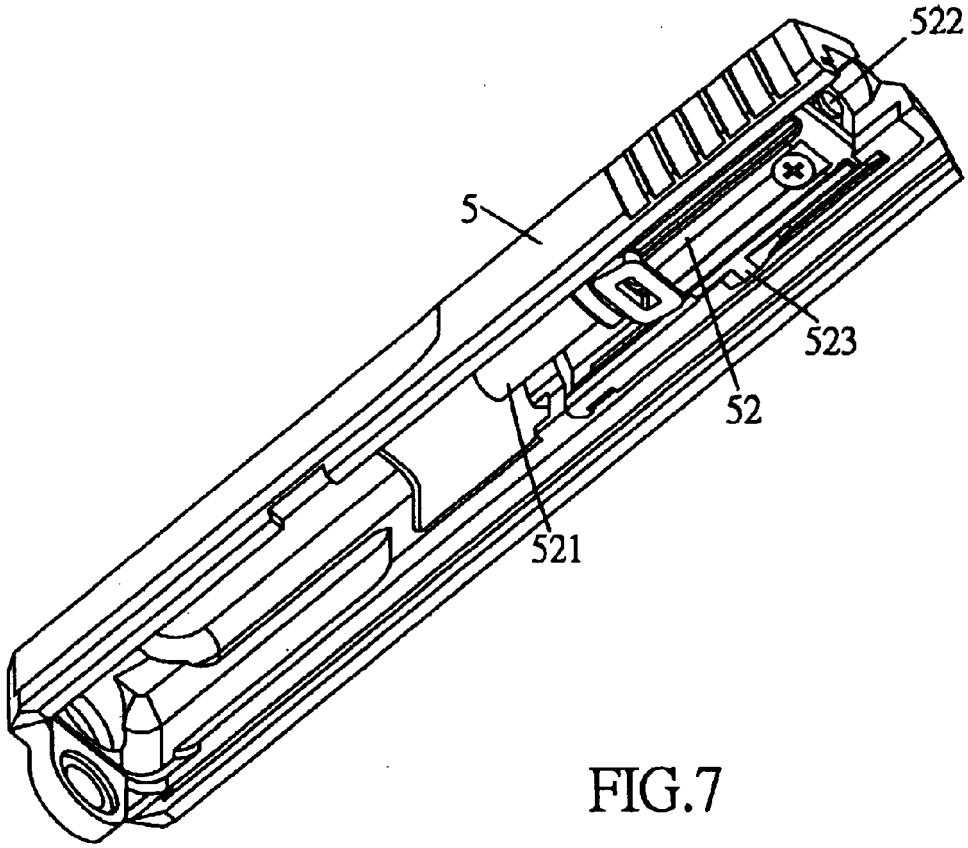
FIG. 7 is a perspective view of a slide of the toy gun as shown in FIG. 1.
Figure 8:
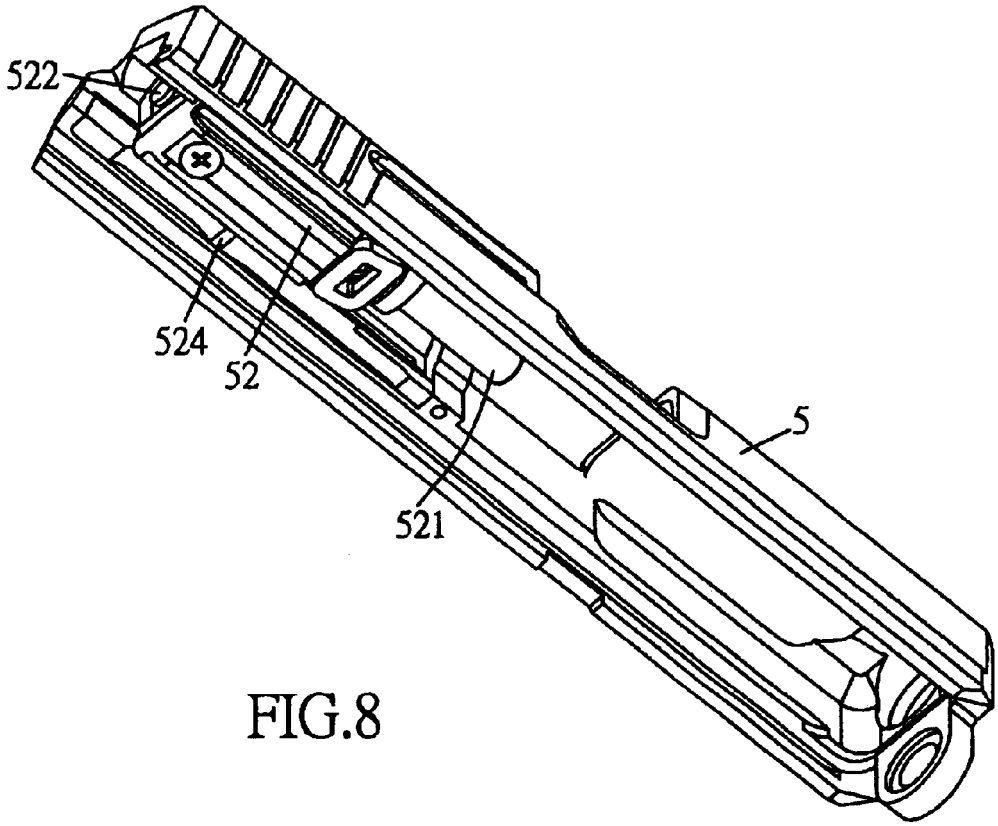
FIG. 8 is a perspective view of a slide of the toy gun as shown in FIG. 1.

As shown in FIGS. 2, 7 and 8, the slide 5 is slidably mounted on the gun body 1 to force the BB bullets 313 into position. The slide 5 has a first end provided with a barrel 51 and a second end provided with a gas guide valve 52. The gas guide valve 52 has a first end provided with a push cylinder 521 and a second end provided with a valve block 522. The gas guide valve 52 has a first side provided with a first pressing block 523 that is moved to press the press plate 42 and a second side provided with a second pressing block 524 that is moved to press the pressed block 412 of the limit plate 47.

In assembly, the link 41 is mounted between the trigger 133 and the hammer 48, with the first end of the link 41 being pivotally connected with an end of the trigger 133, and with the second end of the link 41 being mounted in the opening 221 of the support seat 2. Then, the first shaft 49 is in turn extended through the pivot hole 424 of the press plate 42, the pivot hole 432 of the baffle 43, the pivot hole 441 of the first clamping block 44, the elongated slot 451 of the driven block 45, the pivot hole 461 of the second clamping block 46 and the pivot hole 471 of the limit plate 47, with each of the two ends of the first shaft 49 being mounted in the first through hole 23 of the support seat 2. At this time, the oblique pressing edge 422 of the press plate 42 is urged on the oblique pressing edge 411 of the link 41 as shown in FIG. 6. Then, the second shaft 40 is in turn extended through the pivot hole 481 of the hammer 48, the mounting hole 423 of the press plate 42 and the mounting hole 431 of the baffle 43, with each of the two ends of the second shaft 40 being mounted in the second through hole 24 of the support seat 2. Thus, the gas control device 4 is mounted on the support seat 2. Then, the support seat 2 is mounted in the receiving channel 12 of the gun body 1, and the sleeve 211 and the compression spring 212 are mounted in the spring chamber 21 of the support seat 2. Then, the slide 5 is slidably mounted on the gun body 1. Finally, the magazine 3 is mounted in the magazine chamber 11 of the gun body 1, thereby assembling the toy gun as shown in FIG. 1.

Figure 9:
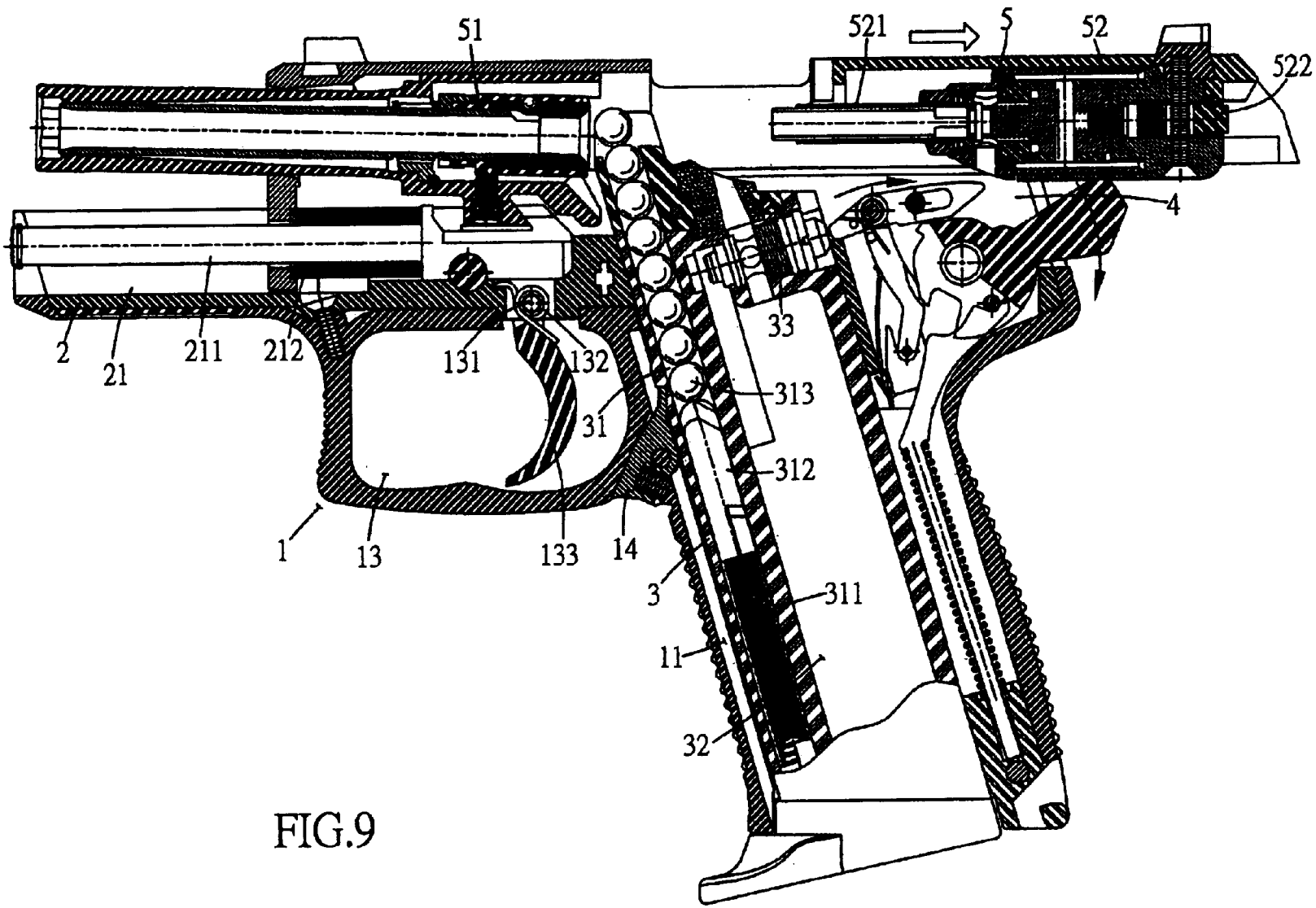
FIG. 9 is a schematic operational view of the toy gun as shown in FIG. 1.
Figure 10:
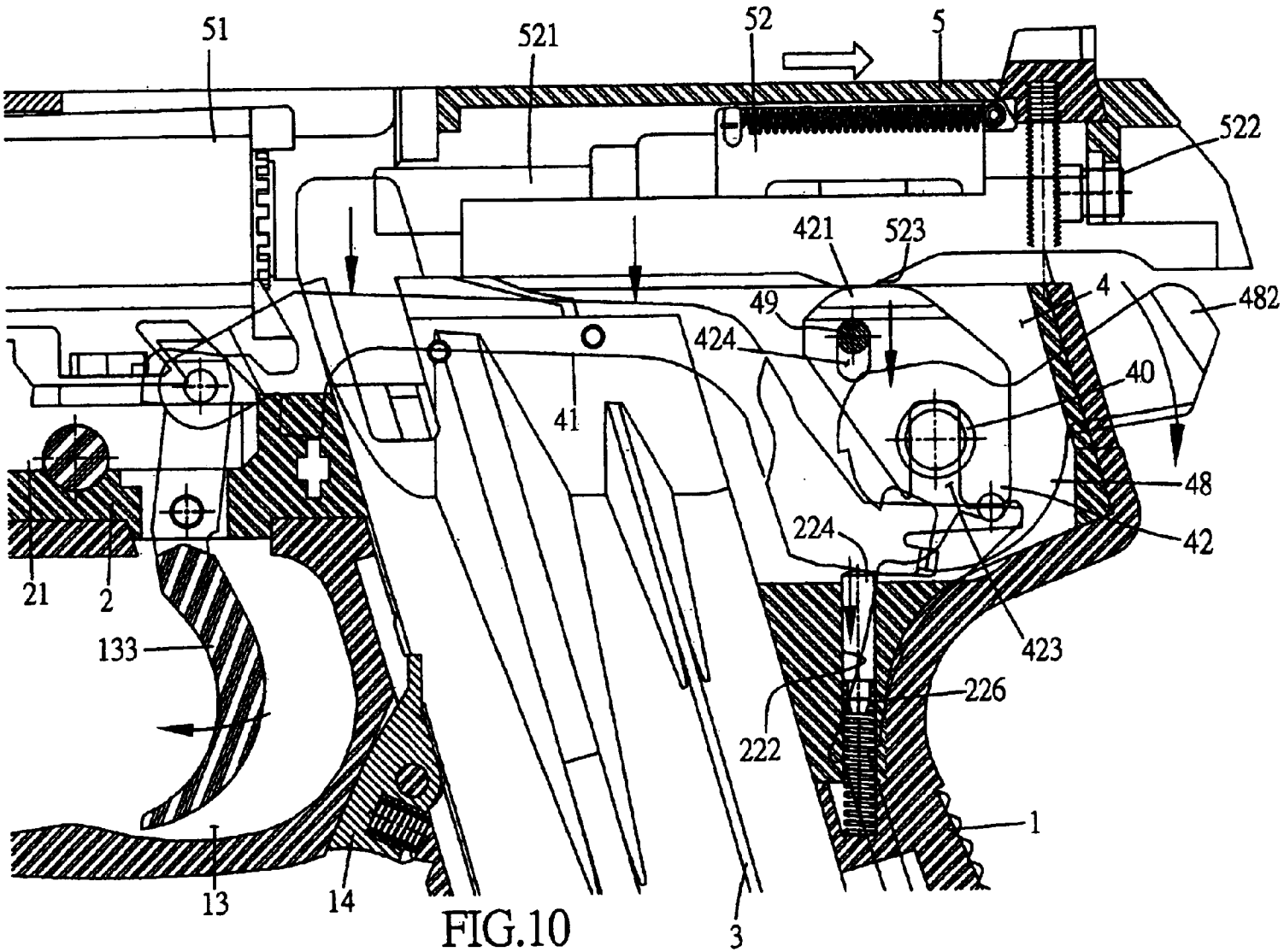
FIG. 10 is a schematic operational view of the toy gun as shown in FIG. 1.

In operation, referring to FIGS. 1–12, when the slide 5 is pulled to move on the gun body 1 backward, the first pressing block 523 of the gas guide valve 52 of the slide 5 is moved to press the press plate 42 of the gas control device 4 downward. At this time, the oblique pressing edge 422 of the press plate 42 is urged on the oblique pressing edge 411 of the link 41 as shown in FIG. 6, so that the link 41 is moved downward by the press plate 42 to press and retract the first push rod 224 of the support seat 2 into the first mounting hole 222, and the trigger 133 is driven by the link 41 to pivot in the clockwise direction as shown in FIG. 10.

Figure 11:
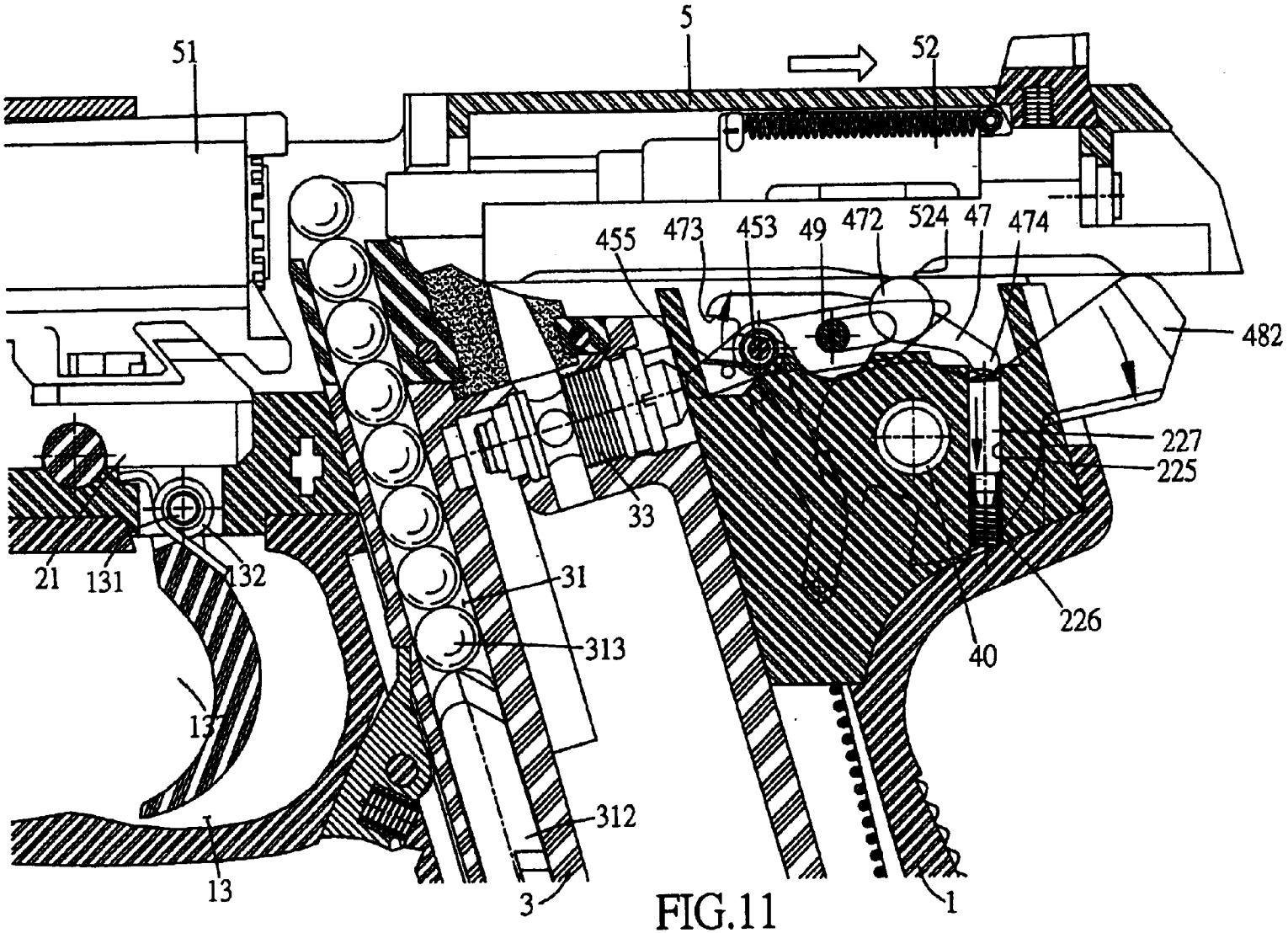
FIG. 11 is a schematic operational view of the toy gun as shown in FIG. 1.

When the slide 5 is further moved backward, the second pressing block 524 of the gas guide valve 52 of the slide 5 is moved to press the pressed block 472 of the limit plate 47, so that the limit plate 47 is pivoted and the pressing portion 474 of the limit plate 47 is moved downward to press and retract the second push rod 227 of the support seat 2 into the second mounting hole 225 as shown in FIG. 11.

When the slide 5 is further moved to the limit position, the striking portion 482 of the hammer 48 is pressed by the slide 5, so that the hammer 48 is pivoted from the position as shown in FIG. 11 to the position as shown in FIG. 10. Thus, the hammer 48 is locked in position and is ready for striking the valve block 522 of the slide 5.

Figure 12:
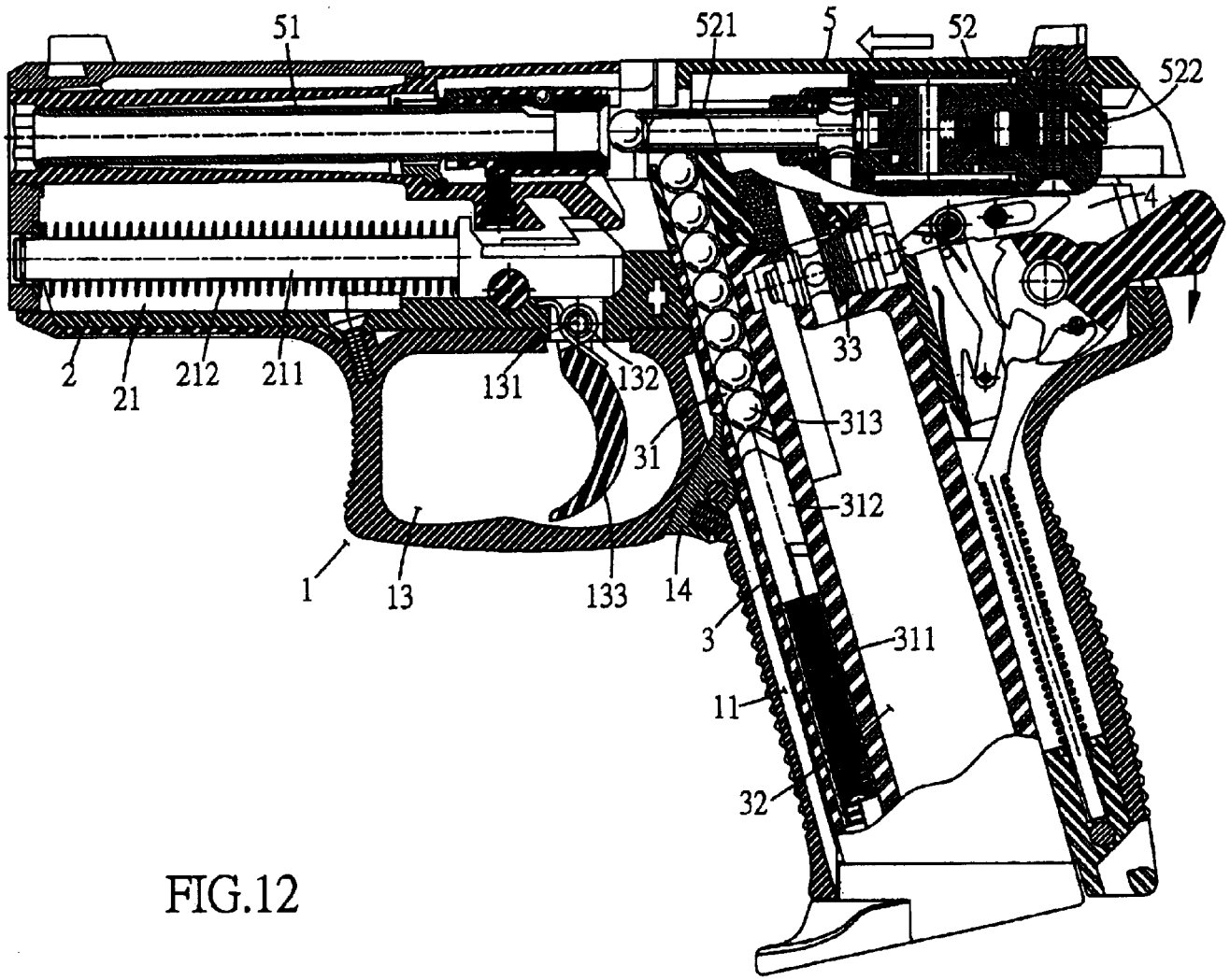
FIG. 12 is a schematic operational view of the toy gun as shown in FIG. 1.

When the slide 5 is moved backward, the BB bullets 313 in the magazine 3 are pushed by the compression spring 311 to move upward, so that the uppermost BB bullet 313 is pressed into the slide 5 and located between the barrel 51 and the push cylinder 521 of the slide 5 as shown in FIG. 9. Thus, when the slide 5 is recoiled forward to move from the position as shown in FIG. 9 to the position as shown in FIG. 12, the uppermost BB bullet 313 is pressed by the push cylinder 521 of the slide 5 into the barrel 51 of the slide 5.

When the user exerts a force to press the trigger 133, the hammer 48 is pivoted by action of the link 41, so that the striking portion 482 of the hammer 48 is moved to strike the valve block 522 of the slide 5.

Thus, the gas guide valve 52 of the slide 5 is actuated to guide the high pressure gas from the gas chamber 32 of the magazine 3 to flow toward the barrel 51 of the slide 5, so that the uppermost BB bullet 313 is pressed by the high pressure gas and is ejected outward from the barrel 51 of the slide 5.

In addition, when the striking portion 482 of the hammer 48 strikes the valve block 522 of the slide 5, the driven block 45 and the action block 455 are driven to move forward to open the gas valve 33 of the gas chamber 32 of the magazine 3, so that the gas flows toward the gas guide valve 52 of the slide 5 and flows back into the gas chamber 32 of the magazine 3.

Accordingly, the gas control device 4 can control operation of the gas valve 33 of the gas chamber 32 of the magazine 3 exactly, so that the toy gun is operated smoothly and stably. In addition, the striking portion 482 of the hammer 48 strikes the valve block 522 of the gas guide valve 52 of the slide 5 to actuate the gas guide valve 52 of the slide 5 to guide the high pressure gas from the gas chamber 32 of the magazine 3 to flow toward the barrel 51 of the slide 5, so that the uppermost BB bullet 313 is pressed by the high pressure gas and is ejected outward from the barrel 51 of the slide 5 rapidly and actually.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A toy gun, comprising a gun body, a support seat, a magazine, and a gas control device, wherein:

the gun body has a vertical section formed with a magazine chamber, a horizontal section formed with a receiving channel and a mediate section provided with a trigger chamber for mounting a trigger;

the support seat is mounted in the receiving channel of the gun body, the support seat has a first end formed with a spring chamber and a second end formed with a receiving recess, the receiving recess of the support seat has a first end having a side formed with an opening having a bottom formed with a first mounting hole for mounting a first compression spring and a first push rod, the receiving recess of the support seat has a second end having a side formed with a second mounting hole for mounting a second compression spring and a second push rod;

the magazine is mounted in the magazine chamber of the gun body;

the gas control device is mounted in the receiving recess of the support seat and includes a link, a press plate, a baffle, a first clamping block, a driven block, a second clamping block, a limit plate, a hammer, a first shaft, and a second shaft, wherein:

the link has a first end pivotally connected with an end of the trigger and a second end mounted in the opening of the support seat, the second end of the link has a first side rested on the first push rod of the support seat and a second side formed with an oblique pressing edge;

the press plate has a first end formed with a pressed block formed with a pivot hole and a second end formed with a mounting hole, the press plate has a side formed with an oblique pressing edge urged on the oblique pressing edge of the link;

the baffle has a first end formed with a pivot hole and a second end formed with a mounting hole, the baffle has a side formed with passage hole;

the first clamping block has a first section formed with a pivot hole and a second section formed with protruding stub;

the driven block has a first end formed with an elongated slot and a second end formed with a pivot hole for passage of a pivot shaft which is extended through a torsion spring, an end of an action block and an end of a lever;

the second clamping block has a first end formed with a pivot hole and a second end formed with a shaft hole;

the limit plate has a first end formed with a cutout for insertion of the pivot shaft of the driven block, a mediate portion formed with a pivot hole, and a second end formed with a pressing portion urged on the second push rod of the support seat, the second end of the limit plate is provided with a pressed block;

the hammer has a first end formed with a pivot hole and a second end formed with a striking portion;

the first shaft is in turn extended through the pivot hole of the, press plate, the pivot hole of the baffle, the pivot hole of the first clamping block, the elongated slot of the driven block, the pivot hole of the second clamping block and the pivot hole of the limit plate; and the second shaft is in turn extended through the pivot hole of the hammer, the mounting hole of the press plate and the mounting hole of the baffle.

2. The toy gun in accordance with claim 1, wherein the gun body is substantially L-shaped.

3. The toy gun in accordance with claim 1, wherein the gun body is provided with a magazine catch located at a connection of the magazine chamber and the trigger chamber.

4. The toy gun in accordance with claim 1, wherein the trigger is pivotally mounted in the trigger chamber by a pivot axle, and a torsion spring is mounted on the pivot axle and urged between the trigger and the gun body.

5. The toy gun in accordance with claim 1, further comprising a sleeve mounted in the spring chamber of the support seat, and a compression spring mounted on the sleeve and received in the spring chamber of the support seat.

6. The toy gun in accordance with claim 1, wherein the pressed block of the press plate is substantially L-shaped.

7. The toy gun in accordance with claim 1, wherein the mounting hole of the press plate is substantially U-shaped.

8. The toy gun in accordance with claim 1, wherein the baffle is a substantially hook-shaped plate.

9. The toy gun in accordance with claim 1, wherein the first clamping block is a substantially L-shaped plate.

10. The toy gun in accordance with claim 1, wherein the second end of the support seat has two side walls each formed with a first through hole and a second through hole.

11. The toy gun in accordance with claim 10, wherein the first shaft has two ends each mounted in the first through hole of the support seat.

12. The toy gun in accordance with claim 10, wherein the second shaft has two ends each mounted in the second through hole of the support seat.

13. The toy gun in accordance with claim 1, wherein the magazine has a first side formed with a bullet chamber for mounting a compression spring, a push block and a plurality of BB bullets.

14. The toy gun in accordance with claim 13, wherein the magazine has a second side formed with a gas chamber having an end provided with a gas valve.

15. The toy gun in accordance with claim 1, further comprising a slide slidably mounted on the gun body and having a first end provided with a barrel and a second end provided with a gas guide valve.

16. The toy gun in accordance with claim 15, wherein the gas guide valve has a first end provided with a push cylinder and a second end provided with a valve block.

17. The toy gun in accordance with claim 15, wherein the gas guide valve has a first side provided with a first pressing block that is moved to press the press plate and a second side provided with a second pressing block that is moved to press the pressed block of the limit plate.

* * * * *